US008359802B1

(12) United States Patent
Burnett et al.

(10) Patent No.: US 8,359,802 B1
(45) Date of Patent: Jan. 29, 2013

(54) CEILING SYSTEM

(75) Inventors: Marvin K. Burnett, Archbold, OH (US); Richard A. Nelson, Napoleon, OH (US); Nolan B. Masters, Weldron, MI (US)

(73) Assignee: Sauder Woodworking Co., Archbold, OH (US)

( * ) Notice: Subject to any disclaimer, the term of this patent is extended or adjusted under 35 U.S.C. 154(b) by 352 days.

(21) Appl. No.: 12/830,488

(22) Filed: Jul. 6, 2010

Related U.S. Application Data

(60) Provisional application No. 61/229,407, filed on Jul. 29, 2009.

(51) Int. Cl.
*E04B 2/00* (2006.01)
*E04B 5/00* (2006.01)
*E04B 9/00* (2006.01)

(52) U.S. Cl. ..... 52/506.08

(58) Field of Classification Search ..... 52/506.06, 52/506.07, 506.08, 506.09, 506.1, 220.6, 52/326, 506.05
See application file for complete search history.

(56) References Cited

U.S. PATENT DOCUMENTS 2,389,171 A * 11/1945 Urbain ..... 52/283
3,618,176 A 11/1971 Barnes
3,936,990 A * 2/1976 Garrison et al. ..... 52/718.01
3,952,985 A 4/1976 Davenport
4,073,458 A 2/1978 Sease
4,112,550 A 9/1978 DeWitt et al.
4,281,498 A * 8/1981 Kern ..... 52/780
4,315,611 A 2/1982 Hoop
4,361,996 A 12/1982 Smith
4,452,021 A * 6/1984 Anderson ..... 52/506.07
4,454,700 A 6/1984 Kern
4,463,537 A 8/1984 Rodriquez et al.
4,464,876 A * 8/1984 Kern ..... 52/506.06
4,546,587 A * 10/1985 Mosch ..... 52/506.08
4,674,254 A 6/1987 Koehler et al.
4,722,161 A 2/1988 Young
4,742,662 A * 5/1988 Smith ..... 52/718.01
4,773,200 A 9/1988 Young
4,848,054 A 7/1989 Blitzer et al.
4,926,606 A * 5/1990 Hanson ..... 52/506.07
5,082,227 A * 1/1992 Insko ..... 248/343
5,239,801 A * 8/1993 Adams ..... 52/506.07
5,265,393 A 11/1993 Bischel et al.
5,355,646 A 10/1994 Bischel et al.

(Continued)

OTHER PUBLICATIONS

"Plasti-clip Hang-Ups," Plasti-clip Web site, at least as early as Oct. 17, 2008, pp. 1-9, published by Plasti-clip, Milford, NH.

(Continued)

*Primary Examiner* — William Gilbert
*Assistant Examiner* — Theodore Adamos
(74) *Attorney, Agent, or Firm* — MacMillan, Sobanski & Todd, LLC

(57) ABSTRACT

A ceiling system for buildings that has, among other things, a first molding having a first molding slot, a second molding having a second molding slot, and a third molding having a third molding slot. The system further includes a molding clip having a support member portion for positioning on a support member and a first molding slot attachment for positioning in the first molding slot. A molding bracket has a first molding surface for positioning on the first molding and a second molding slot projection for positioning in the second molding slot. A rail clip has a rail end for positioning on a side rail and a slot end for positioning in the third molding slot. The system has a panel for positioning adjacent to the first, second and third moldings.

20 Claims, 13 Drawing Sheets

U.S. PATENT DOCUMENTS

| | | | | |
|---|---|---|---|---|
| 5,433,048 | A * | 7/1995 | Strasser | 52/288.1 |
| 5,457,925 | A | 10/1995 | Koedyker | |
| 5,490,651 | A * | 2/1996 | Kump | 248/222.12 |
| 5,535,566 | A | 7/1996 | Wilson et al. | |
| 5,619,833 | A * | 4/1997 | Neff | 52/506.07 |
| 5,836,127 | A | 11/1998 | Clark et al. | |
| 5,845,447 | A * | 12/1998 | Bodine et al. | 52/506.09 |
| 5,970,669 | A | 10/1999 | Livingston | |
| 5,979,134 | A | 11/1999 | Neff | |
| 6,029,413 | A | 2/2000 | Compas, Jr. | |
| 6,077,593 | A | 6/2000 | Schlachter | |
| 6,092,777 | A | 7/2000 | Kuntz | |
| 6,101,777 | A | 8/2000 | Bodine et al. | |
| 6,145,264 | A | 11/2000 | Dallaire | |
| 6,205,733 | B1 | 3/2001 | LaLonde | |
| 6,230,463 | B1 | 5/2001 | Bodine | |
| D446,110 | S | 8/2001 | McDuff et al. | |
| 6,270,915 | B1 | 8/2001 | Turpin et al. | |
| 6,305,137 | B1 | 10/2001 | Rebman | |
| 6,305,495 | B1 | 10/2001 | Keegan | |
| 6,324,806 | B1 | 12/2001 | Rebman | |
| 6,467,228 | B1 | 10/2002 | Wendt et al. | |
| 6,536,173 | B2 | 3/2003 | Rebman | |
| 6,574,936 | B1 * | 6/2003 | Anderson, Sr. | 52/506.06 |
| 6,892,500 | B2 | 5/2005 | Zaborowski | |
| 7,117,650 | B2 | 10/2006 | Dockery | |
| 2007/0283656 | A1 * | 12/2007 | Anderson | 52/506.06 |
| 2008/0276560 | A1 * | 11/2008 | Labonte | 52/506.06 |

OTHER PUBLICATIONS

"Ceiling Accessories," FFR Web site, at least as early as Oct. 20, 2008, pp. 1-5, published by FFR, Twinsburg, OH.

Merle Henkenius, "How to Install a Suspended Ceiling," Popular Mechanics Web site, pp. 1-3, at least as early as Apr. 16, 2010, published by Hearst Communications, Inc., New York, NY.

"ACP Suspended PVC Ceiling Grid," The Home Depot Web site, at least as early as Apr. 16, 2010, pp. 1-2, published by the Home Depot, Inc., Atlanta, GA.

"Grid Ceiling Systems," Colorado Ceilings Web site, pp. 1-2, at least as early as Apr. 16, 2010, published by IDS Group, Denver, CO.

"Chicago Metallic Suspended Ceiling Grid Tee 2'," eBay Web site, pp. 1-2, at least as early as Apr. 16, 2010, published by eBay Inc., San Jose, CA.

* cited by examiner

CEILING SYSTEM

CROSS-REFERENCE TO RELATED APPLICATIONS

This is related to and claims the benefit of U.S. Provisional Patent Application No. 61/229,407, which was filed on Jul. 29, 2009.

TECHNICAL FIELD

The invention relates generally to ceilings for buildings. More specifically, the invention is directed to a ceiling system that is suspended from an existing ceiling or other structure.

BACKGROUND OF THE INVENTION

Existing ceiling systems are often unattractive and difficult to assemble. The invention provides an attractive and easy-to-assemble ceiling system.

BRIEF SUMMARY OF THE INVENTION

A ceiling system that has, among other things, a first molding having a first molding slot, a second molding having a second molding slot, and a third molding having a third molding slot. The system further includes a molding clip having a support member portion for positioning on a support member and a first molding slot attachment for positioning in the first molding slot. A molding bracket has a first molding surface for positioning on the first molding and a second molding slot projection for positioning in the second molding slot. A rail clip has a rail end for positioning on a side rail and a slot end for positioning in the third molding slot. The system has a panel for positioning adjacent to the first, second and third moldings.

DETAILED DESCRIPTION OF THE INVENTION

Figure 1:
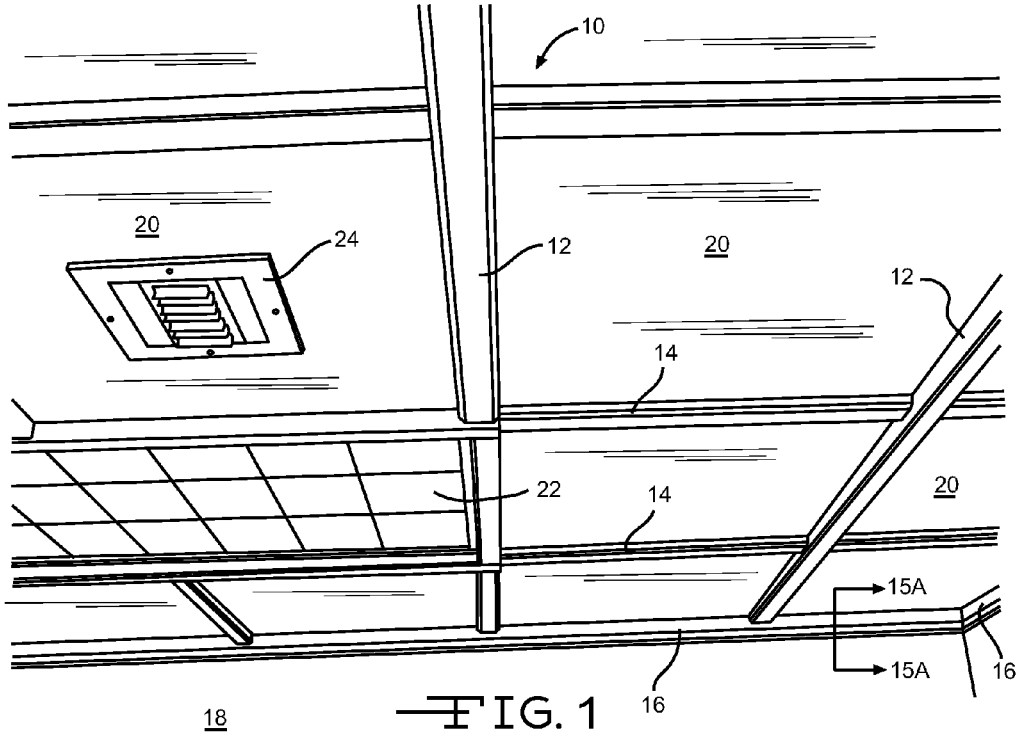
FIG. 1 is a perspective view of an embodiment of the ceiling system according to the invention.
Figure 2:
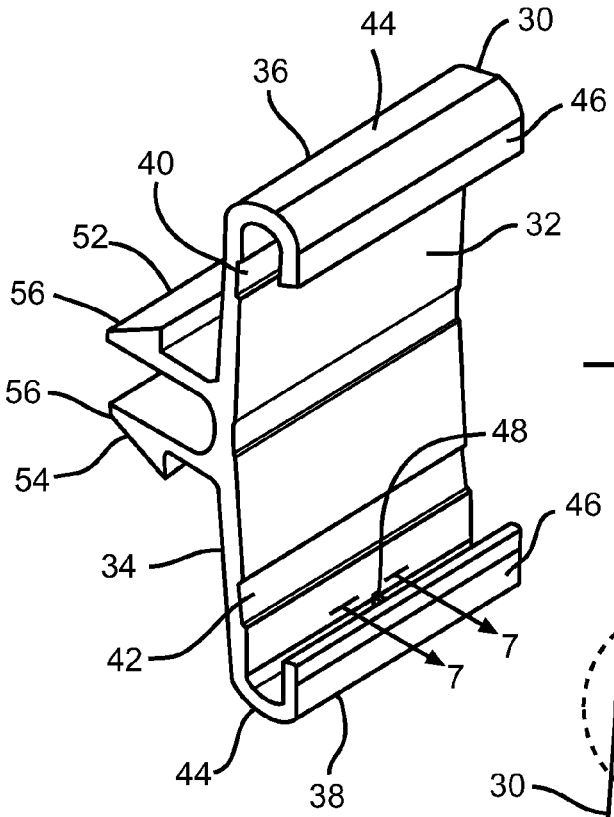
FIG. 2 is a perspective view of an embodiment of the molding clip according to the invention.
Figure 3:
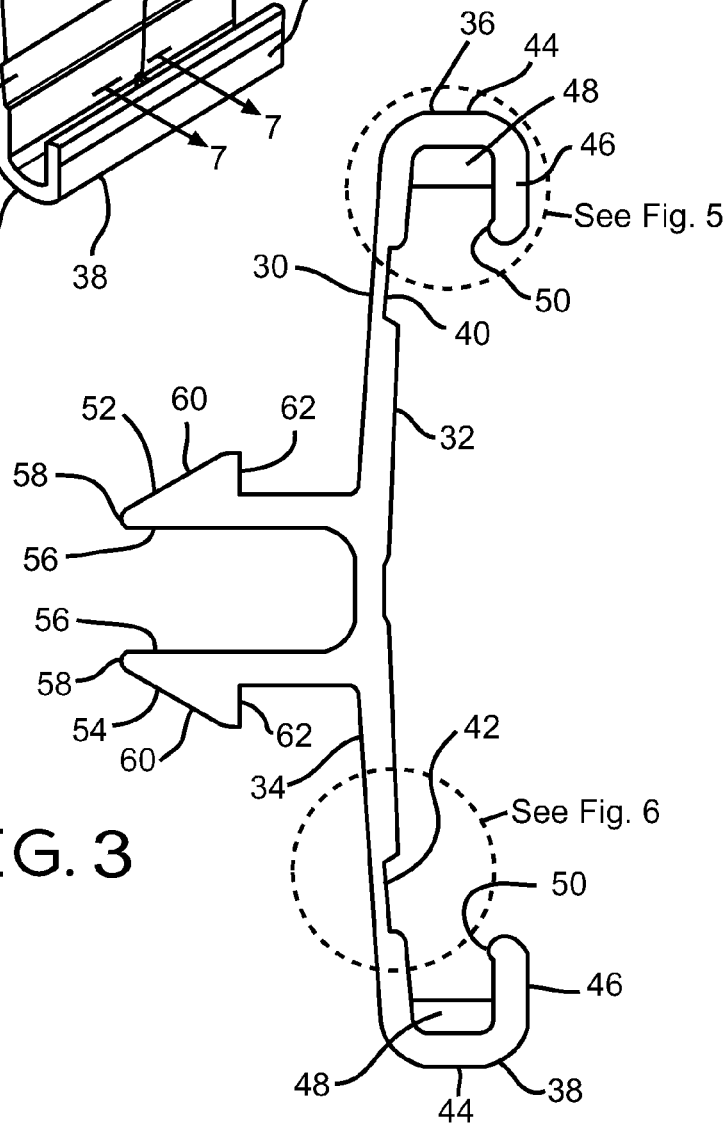
FIG. 3 is a side elevational view of the molding clip shown in FIG. 2.
Figure 4:
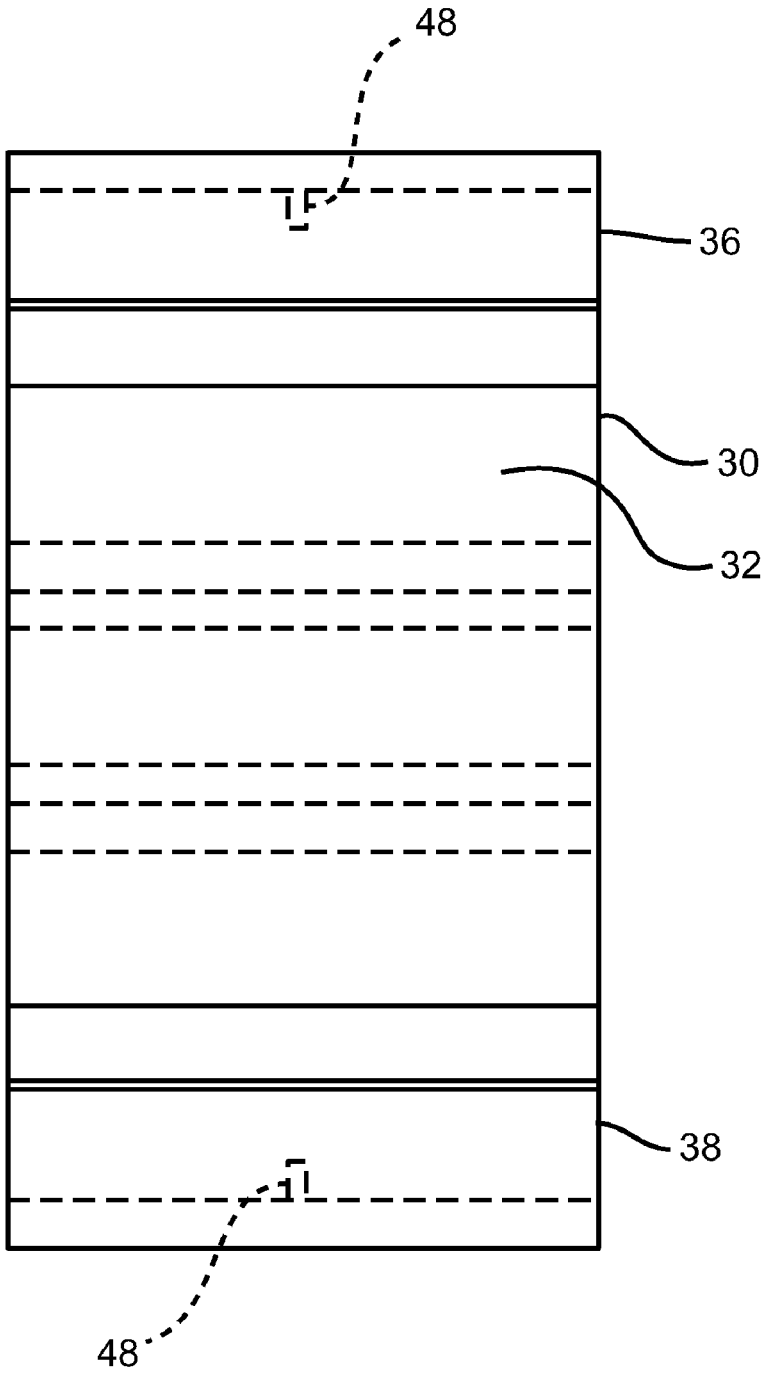
FIG. 4 is a top plan view of the molding clip shown in FIG. 2.
Figure 5:
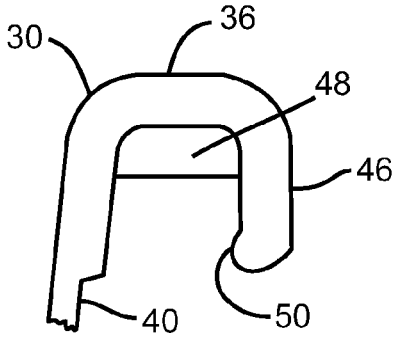
FIG. 5 is an enlarged view as indicated in FIG. 2.
Figure 6:
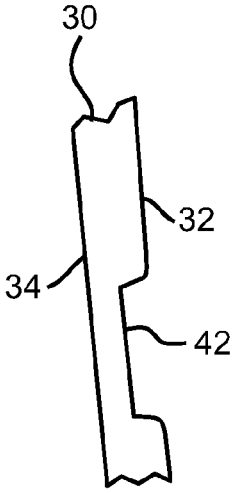
FIG. 6 is an enlarged view as indicated in FIG. 2.

Referring to the drawings, an embodiment of the ceiling system according to the invention is indicated generally by the reference number "10." As shown in FIG. 1, the ceiling system 10 has, among other things, vertical moldings 12, horizontal moldings 14, side moldings 16 positioned adjacent walls 18, and ceiling panels 20. The ceiling system 10 may also have light fixtures 22 and vents 24.

Referring to FIGS. 2-7, the molding clip 30 of the ceiling system 10 has a support member side 32, a molding side 34, a molding clip first end 36, and a molding clip second end 38. The support member side 32 has a first indentation 40 adjacent to the first end 36 and a second indentation 42 positioned adjacent to the second end 38. Each of the first and second ends 36 and 38 has a first portion 44 that is positioned generally perpendicular to the support member side 32 and a second portion 46 that is positioned generally parallel to the support member side 32. Each of the first and second ends 36 and 38 has a support member projection 48 that projects outwardly from the first portion 44 between the support member side 32 and the second portion 46. Each of the first and second ends 36 and 38 also has an end projection 50 that projects inwardly from the second portion toward the support member side 32. The molding side 34 of the molding clip 30 has first and second molding attachment portions 52 and 54. In an embodiment, the first and second molding attachment portions 52 and 54 extend outwardly from the molding side 34 in a generally parallel relationship to one another. Each of the first and second molding attachment portions 52 and 54 has attachment ends 56 that include a point 58, a chamfered surface 60, and a support surface 62. In an embodiment, the molding clip 30 is constructed of plastic material, such as polypropylene.

Figure 7:
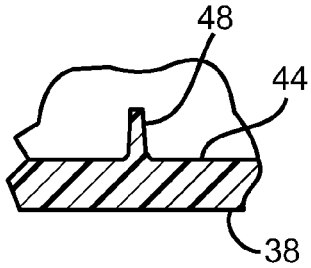
FIG. 7 is a cross-sectional view taken along line 7-7 of FIG. 2.
Figure 7A:
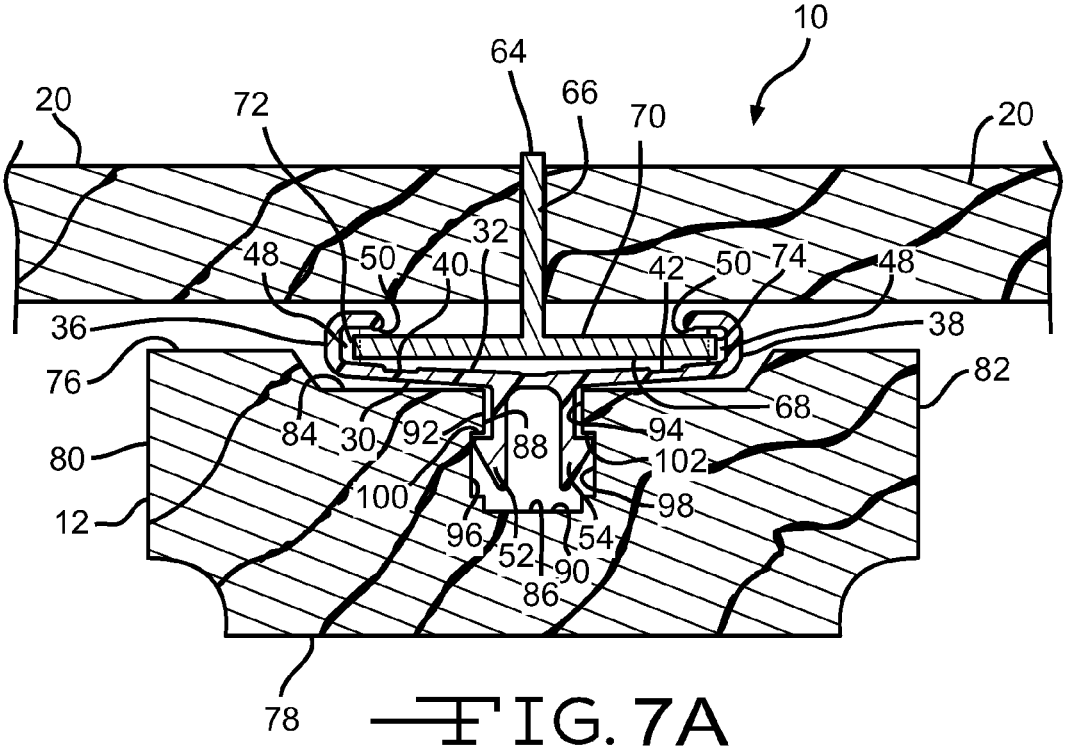
FIG. 7A is a side elevational view showing an embodiment of the ceiling system according to the invention in which the molding clip is positioned on a T-shaped support member, the molding is positioned under the molding clip, and the ceiling panels are positioned above the molding clip.
Figure 8:
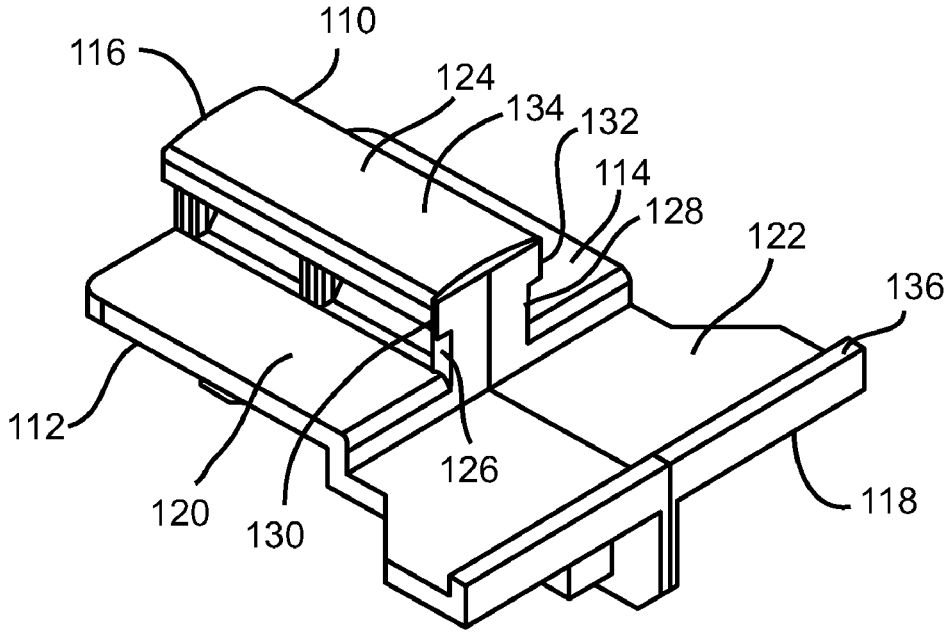
FIG. 8 is a perspective view of an embodiment of the molding bracket according to the invention.
Figure 9:
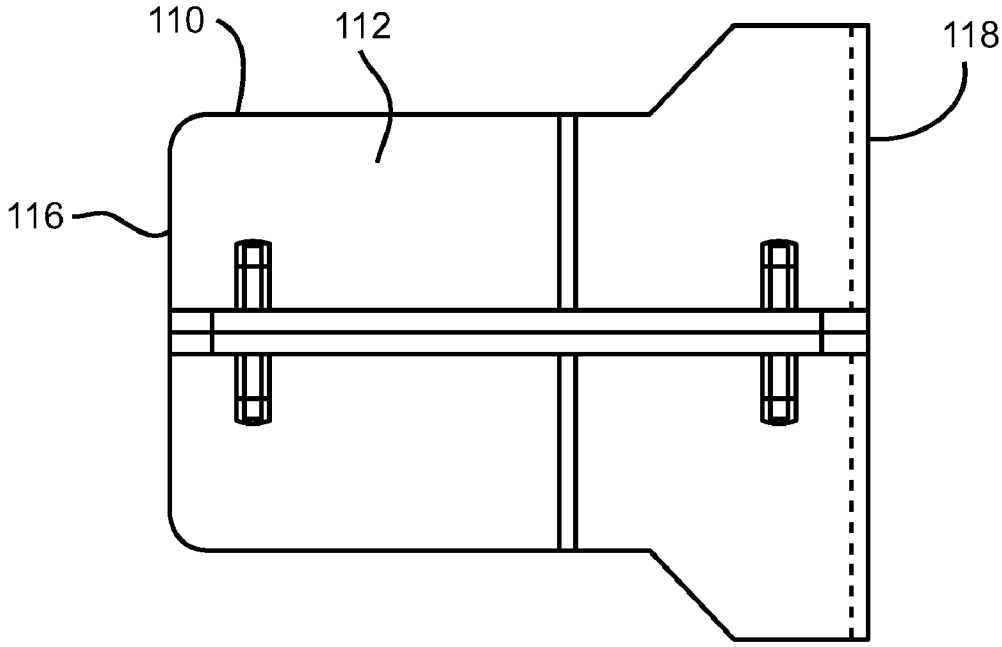
FIG. 9 is a top plan view of the molding bracket shown in FIG. 8.
Figure 10:
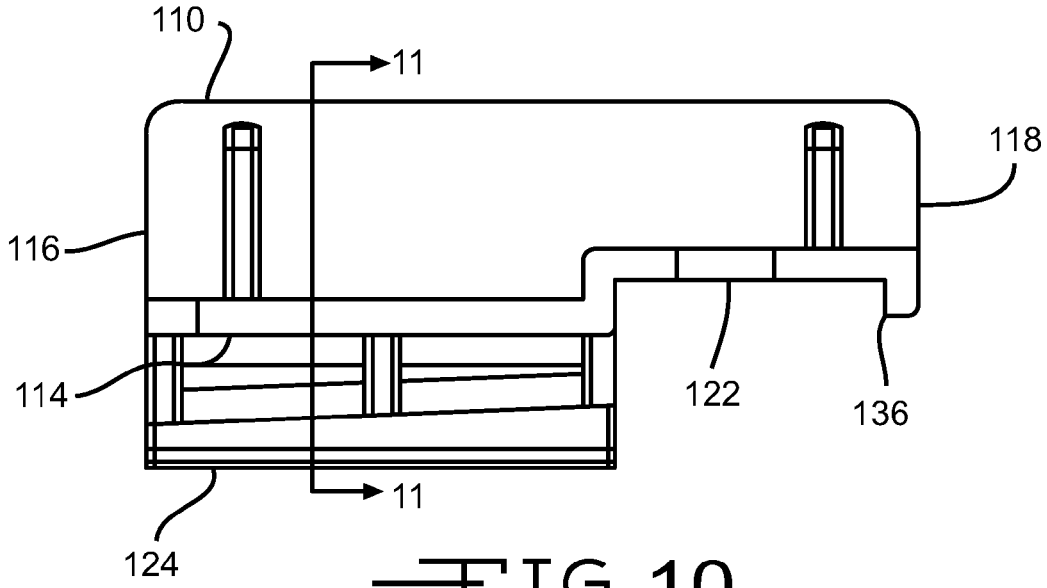
FIG. 10 is a side elevational view of the molding bracket shown in FIG. 8.
Figure 11:
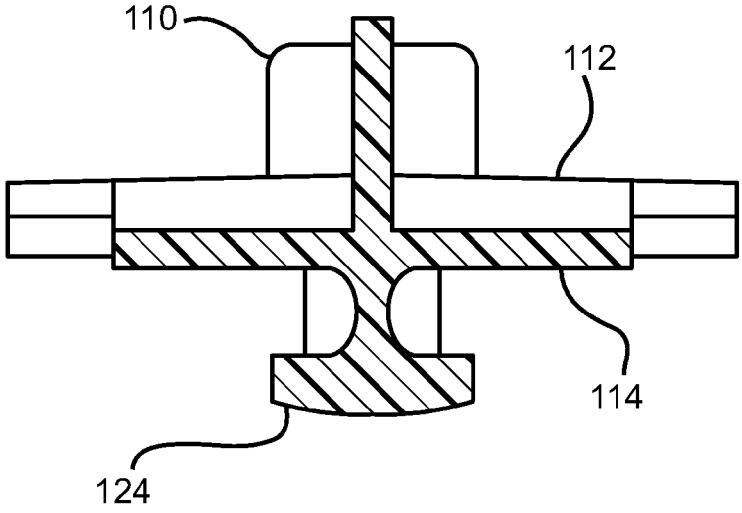
FIG. 11 is a cross-sectional view taken along line 11-11 of FIG. 10.
Figure 12:
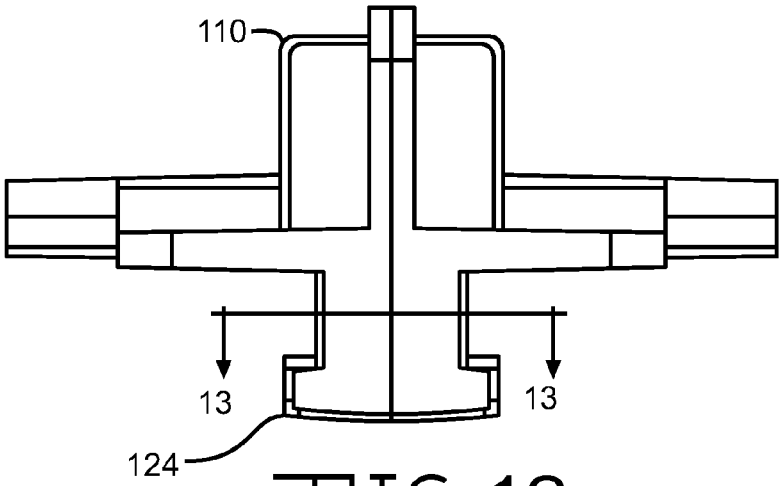
FIG. 12 is an end view of the molding bracket shown in FIG. 8.

As shown in FIG. 7A, an embodiment ceiling system 10 has a flexible molding clip 30 positioned on a T-shaped support member 64 that is, for example, suspended from an existing ceiling or other structure (not shown). The support member 64 has a suspension portion 66, a clip surface 68, a ceiling surface 70, a first support portion 72, and a second support portion 74. Due to its flexible construction and shape, the molding clip 30 can be snapped onto the support member 64. The molding clip 30 may also be slid onto the support member 64. When positioned, the support member side 32 of the molding clip 30 is adjacent to the clip surface 68 of the support member 64. The molding clip first and second ends 36 and 38 are adjacent to the first and second support portions 72 and 74, respectively. This allows for the firm attachment of the molding clip 30 on the support member 64.

Still referring to FIG. 7A, the molding clip 30 supports the vertical moldings 12 and the horizontal moldings 14 of the ceiling system 10 (see FIG. 1). As shown in FIG. 7A, each of the vertical and horizontal moldings 12 and 14 has a molding interior surface 76, a molding exterior surface 78, a molding first side 80, and a molding second side 82. The interior surface 76 includes a clip recess 84. The molding 12 has a molding slot 86 that is sized and adapted to correspond to the first and second attachment portions 52 and 54 of the molding clip 30. In an embodiment, the molding slot 86 has a generally T-shaped configuration in which there is a narrow portion 88 and an enlarged portion 90. The narrow portion 88 has first and second narrow portion walls 92 and 94 that are generally parallel to one another. The enlarged portion 90 has first and second enlarged portion walls 96 and 98 that are generally parallel to one another. The enlarged portion 90 also has first and second attachment walls 100 and 102 that are parallel to one another and on the same plane. The first and second attachment walls 100 and 102 are positioned adjacent to and in a generally perpendicular relationship with the first and second narrow portion walls 92 and 94, respectively. The molding 12 can be snapped onto the flexible molding clip 30 by inserting the first and second attachment portions 52 and 54 of the molding clip 30 in the molding slot 86. In this regard, the points 58 are positioned in the narrow portion 88. As the molding 12 is moved toward the flexible molding clip 30, the chamfered surfaces 60 engage the molding 12 to allow the first and second attachment portions 52 and 54 to move toward one another to allow for passage through the narrow portion 88. The support surfaces 62 of the first and second attachment portions 52 and 54 engage the first and second enlarged portion walls 96 and 98 and the first and second attachment walls 100 and 102, respectively, upon expansion of the first and second attachment portions 52 and 54 in the enlarged portion 90. This allows for the firm attachment of the molding 12 on the molding clip 30. As shown, the molding clip 30 is positioned in the clip recess 84 of the molding 12. The molding 12 may also be slid onto the molding clip 30. In an embodiment, the molding 12 is constructed of a wooden material, such as a wood composite material having a paper laminate surface.

Still referring to FIG. 7A, the ceiling panels 20 of the ceiling system 10 are positioned adjacent to the molding 12, the molding clip 30 and the support member 64. In an embodiment, the ceiling panels 20 are constructed of a wooden material, such as a wood composite material having a paper laminate surface.

Referring now to FIGS. 8-13, the molding bracket 110 of the ceiling system 10 has an outer side 112, an inner side 114, a molding bracket first end 116, and a molding bracket second end 118. The inner side 114 has a first surface 120 and a second surface 122. In an embodiment, the first and second surfaces 120 and 122 are generally parallel on different planes. A slot projection 124 is positioned on the first surface 120. In an embodiment, the slot projection 124 has a generally T-shaped configuration in which there are opposed first and second narrow projection sides 126 and 128, opposed first and second enlarged projection sides 130 and 132, and a slot surface 134. The slot surface 134 curves outwardly between the first and second enlarged projection sides 130 and 132. A recess projection 136 extends from the second surface 122 in a generally perpendicular relationship. In an embodiment, the molding bracket 110 is constructed of a plastic material, such as polypropylene.

Figure 13:
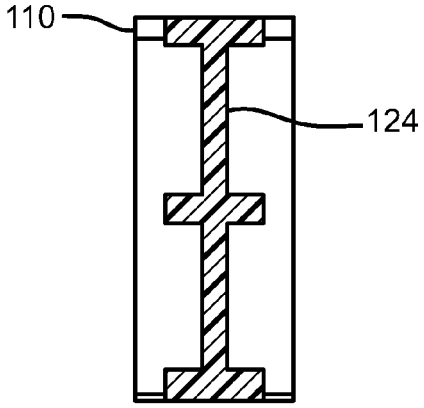
FIG. 13 is a cross-sectional view taken along line 13-13 of FIG. 12.
Figure 13A:
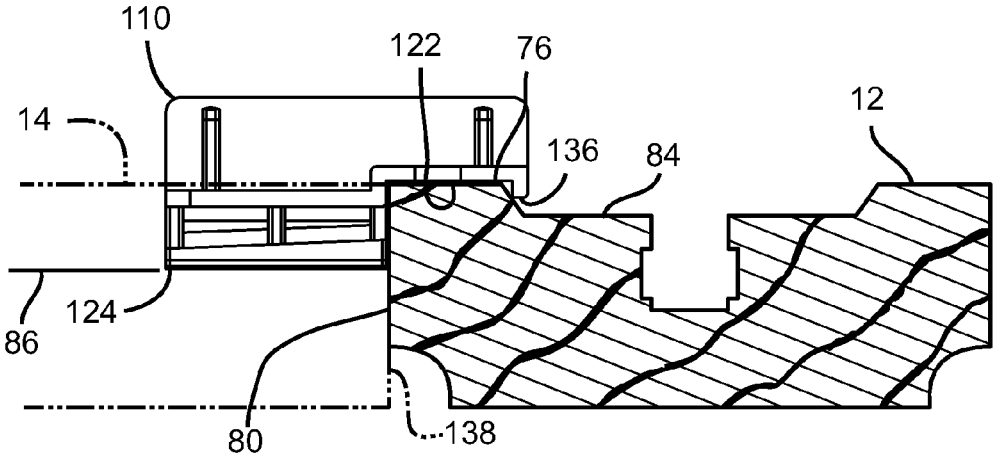
FIG. 13A is a side elevational view showing an embodiment of the ceiling system according to the invention in which the molding bracket is positioning one molding on another molding.

As shown in FIG. 13A, an embodiment ceiling system 10 has, for example, a vertical molding 12 positioned adjacent to a horizontal molding 14 (see FIG. 1). To support the horizontal molding 14 in position, the slot projection 124 of the molding bracket 110 is positioned in the molding slot 86 of the horizontal molding 14. The second surface 122 of the molding bracket 110 is positioned on the interior surface 76 of the vertical molding 12. The recess projection 136 of the molding bracket 110 is positioned in the clip recess 84 of the vertical molding 12. The first side 80 of the vertical molding 12 abuts the end 138 of the horizontal molding 14. The molding bracket 110 is used, for example, when a support member 64 is not available in the ceiling system 10. In an embodiment, the molding bracket 110 provides the capability to convert a 2×4 ceiling system to a 2×2 ceiling system.

Figure 14:
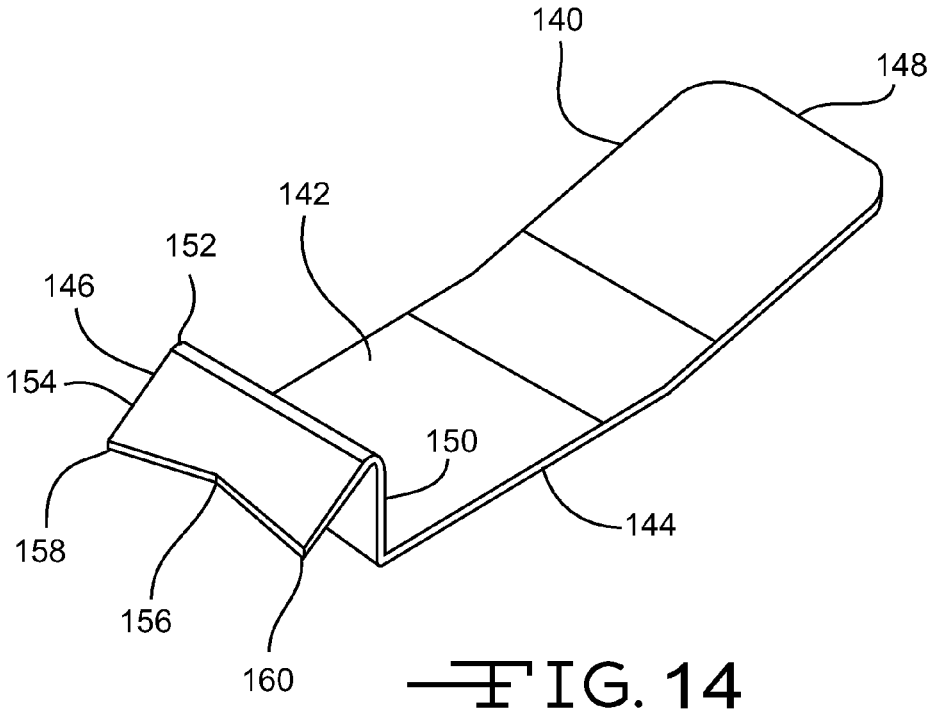
FIG. 14 is a perspective view of an embodiment of the rail clip according to the invention.
Figure 15:
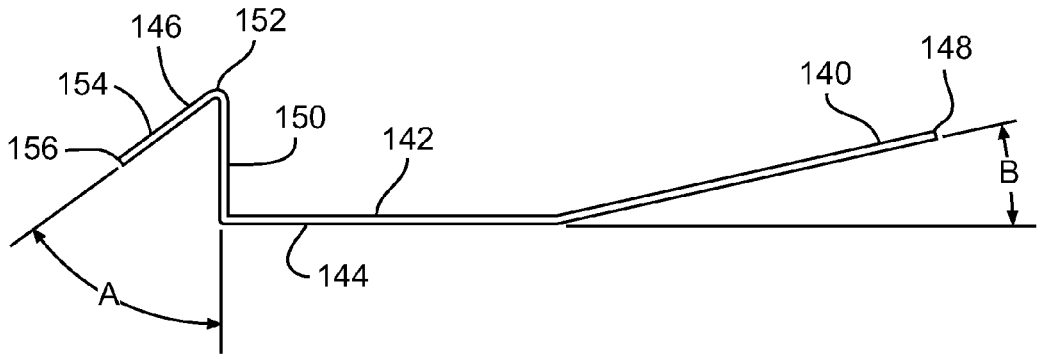
FIG. 15 is a side elevational view of the rail clip shown in FIG. 14.

Referring to FIGS. 14 and 15, the rail clip 140 of the ceiling system 10 has a first side 142, a second side 144, a slot end 146, and a rail end 148. The slot end 146 has a first portion 150 having a corner 152 and a second portion 154 having an edge 156. The first and second portions 150 and 154 are positioned at a predetermined angle A with respect to one another. In an embodiment, the predetermined angle A is about 155°. The edge 156 has first and second points 158 and 160. The rail end 148 is positioned at a predetermined angle B with respect to the second side 144. In an embodiment, the predetermined angle B is about 13°. In an embodiment, the rail clip is constructed of metal, such as steel.

Figure 15A:
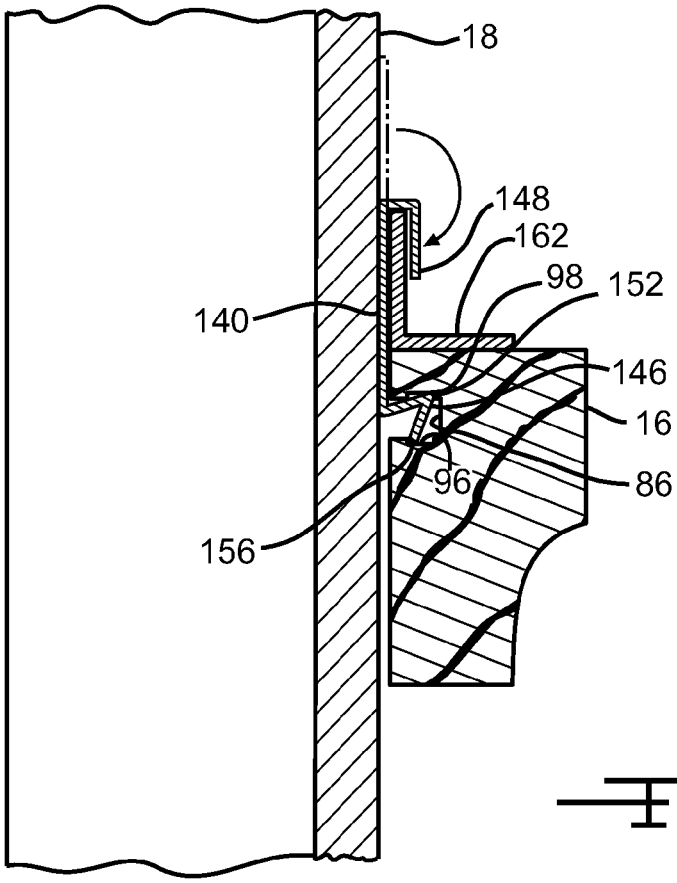
FIG. 15A is a cross-sectional view taken along line 16-16 of FIG. 1 showing an embodiment of the ceiling system according to the invention in which the rail clip is positioning a molding on the side rail adjacent to a wall.

As shown in FIG. 15A, the bendable rail clip 140 supports a side molding 16 on a side rail 162 positioned on a wall 18 (see FIG. 1). In this regard, the slot end 146 is positioned in the molding slot 86 of the side molding 16 so that the corner 152 engages the second enlarged portion wall 98 and the first and second points 158 and 160 of the edge 156 engage the first enlarged portion wall 96. The rail end 148 is positioned between the wall 18 and the side rail 162. A portion of the rail end 148 is bent around a portion of the side rail 162 as shown by the arrow in FIG. 15A to support the side molding 16.

Figure 16:
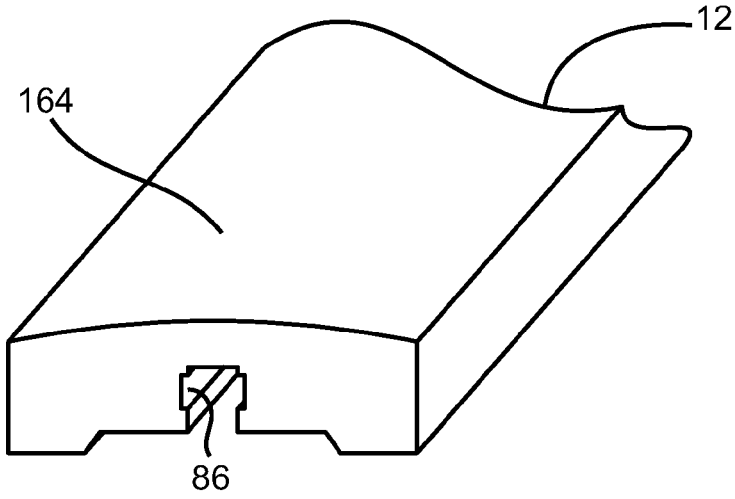
FIG. 16 is a perspective view of an embodiment of the molding according to the invention.

FIG. 16 shows an alternative embodiment molding, such as vertical molding 12, having a rounded exterior surface 164.

Figure 17:
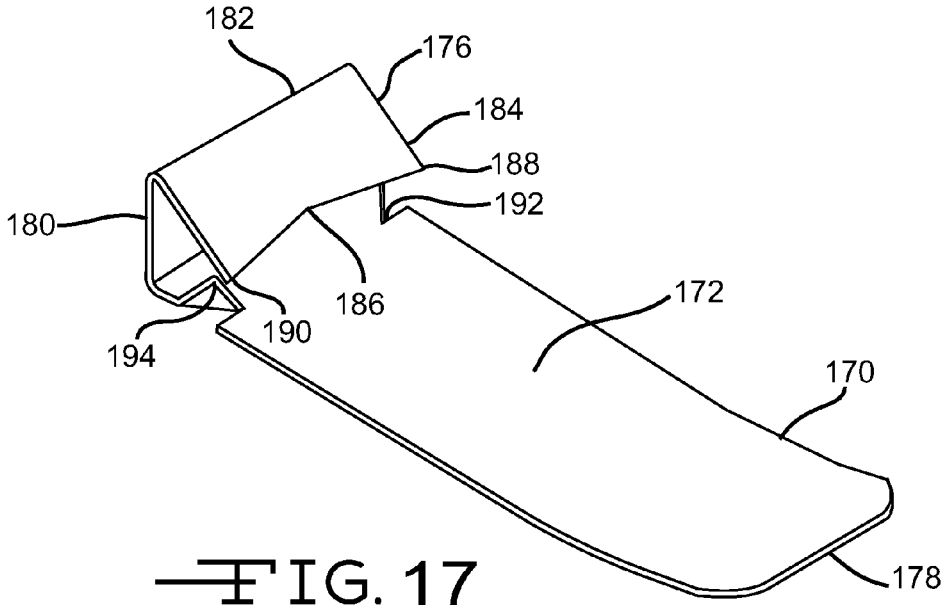
FIG. 17 is a perspective view of an alternative embodiment of the rail clip according to the invention.
Figure 18:
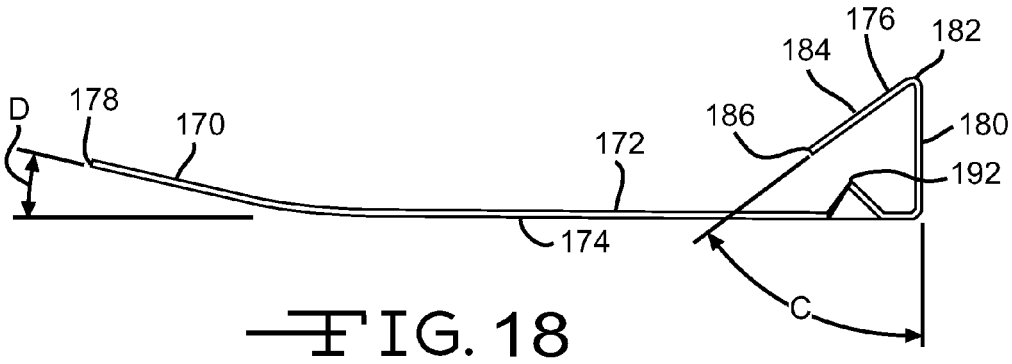
FIG. 18 is a side elevational view of the rail clip shown in FIG. 17.
Figure 19:
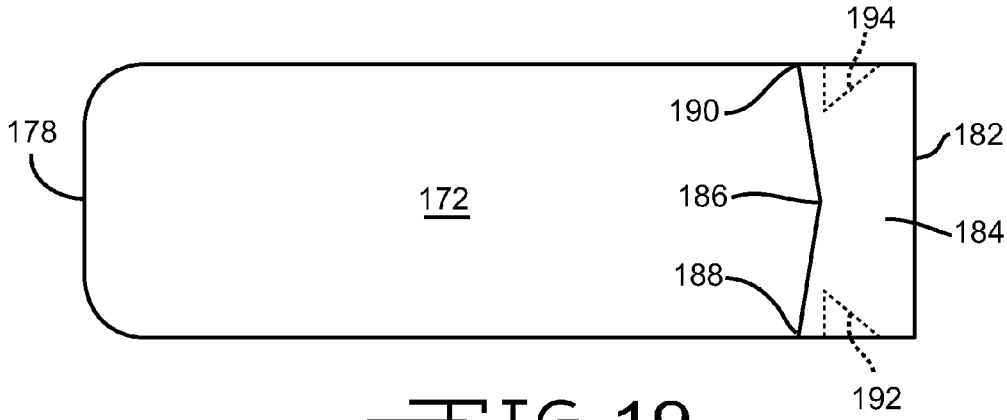
FIG. 19 is a top plan view of the rail clip shown in FIG. 17.

Referring to FIGS. 17-19, an alternative embodiment rail clip 170 of the ceiling system 10 has a first side 172, a second side 174, a slot end 176, and a rail end 178. The slot end 176 has a first portion 180 having a corner 182 and a second portion 184 having an edge 186. The edge 186 has first and second points 188 and 190. The second portion 184 extends generally toward the rail end 178. The rail clip 170 has first and second clip projections 192 and 194 extending from the first side 172 generally toward the second portion 184. The first and second portions 180 and 184 are positioned at a predetermined angle C with respect to one another. In an embodiment, the predetermined angle C is about 155°. The rail end 178 is positioned at a predetermined angle D with respect to the second side 174. In an embodiment, the predetermined angle C is about 13°. In an embodiment, the rail clip 170 is constructed of metal, such as steel.

Figure 20:
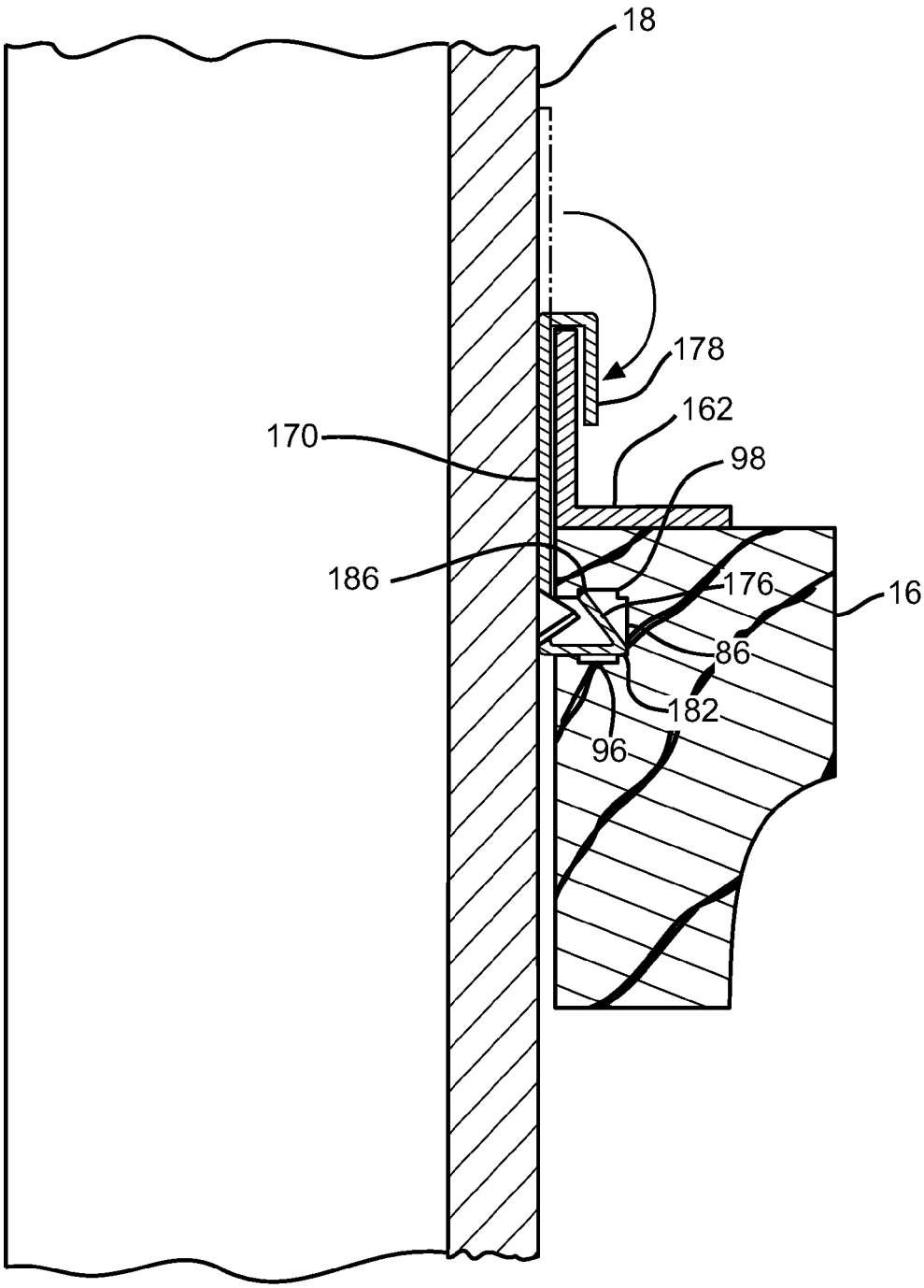
FIG. 20 is a view similar to the view of FIG. 15A showing an embodiment of the ceiling system according to the invention in which the rail clip shown in FIG. 17 is positioning a molding on the side rail adjacent to a wall.

As shown in FIG. 20, the bendable rail clip 170 supports a side molding 16 on a side rail 162 positioned on a wall 18 (see FIG. 1). In this regard, the slot end 176 is positioned in the molding slot 86 of the side molding 16 so that the corner 182 engages the first enlarged portion wall 96 and the first and second points 188 and 190 engage the second enlarged portion wall 98. The rail end 178 is positioned between the wall 18 and the side rail 162 as shown by the arrow in FIG. 20 to support the side molding 16.

Figure 21:
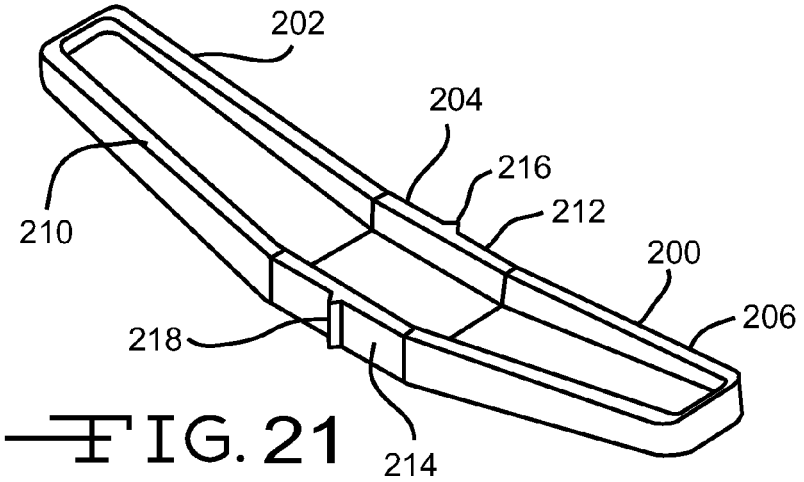
FIG. 21 is a perspective view of an embodiment of the joining clip according to the invention.
Figure 22:
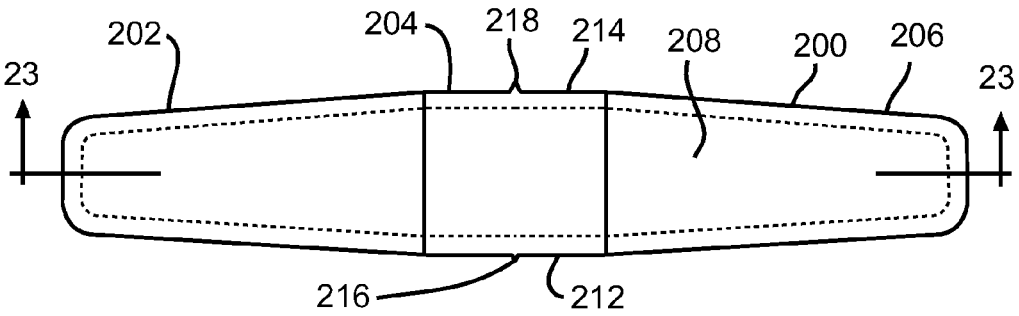
FIG. 22 is a top plan view of the joining clip shown in FIG. 21.
Figure 23:
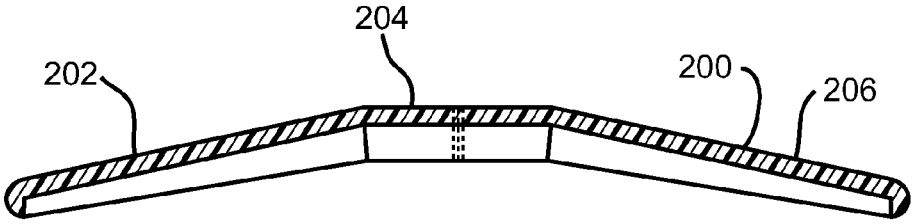
FIG. 23 is a cross-sectional view taken along line 23-23 of FIG. 21.

Referring to FIGS. 21-23, an embodiment of a joining clip 200 of the ceiling system 10 is shown. The joining clip 200 has a first end 202, a center portion 204, a second end 206, a first side 208, a second side 210, a first wall 212 and a second wall 214. The center portion 204 has a first member 216 that projects outwardly from the first wall 212 and extends between the first and second sides 208 and 210. The center portion 204 further has a second member 218 that projects outwardly from the second wall 214 and extends between the first and second sides 208 and 210. As shown in FIG. 23, the joining clip 200 is bowed in which the first and second ends 202 and 204 are on different planes with respect to the center portion 204. In an embodiment, the joining clip 200 is constructed of plastic material, such as polypropylene.

Figure 24:
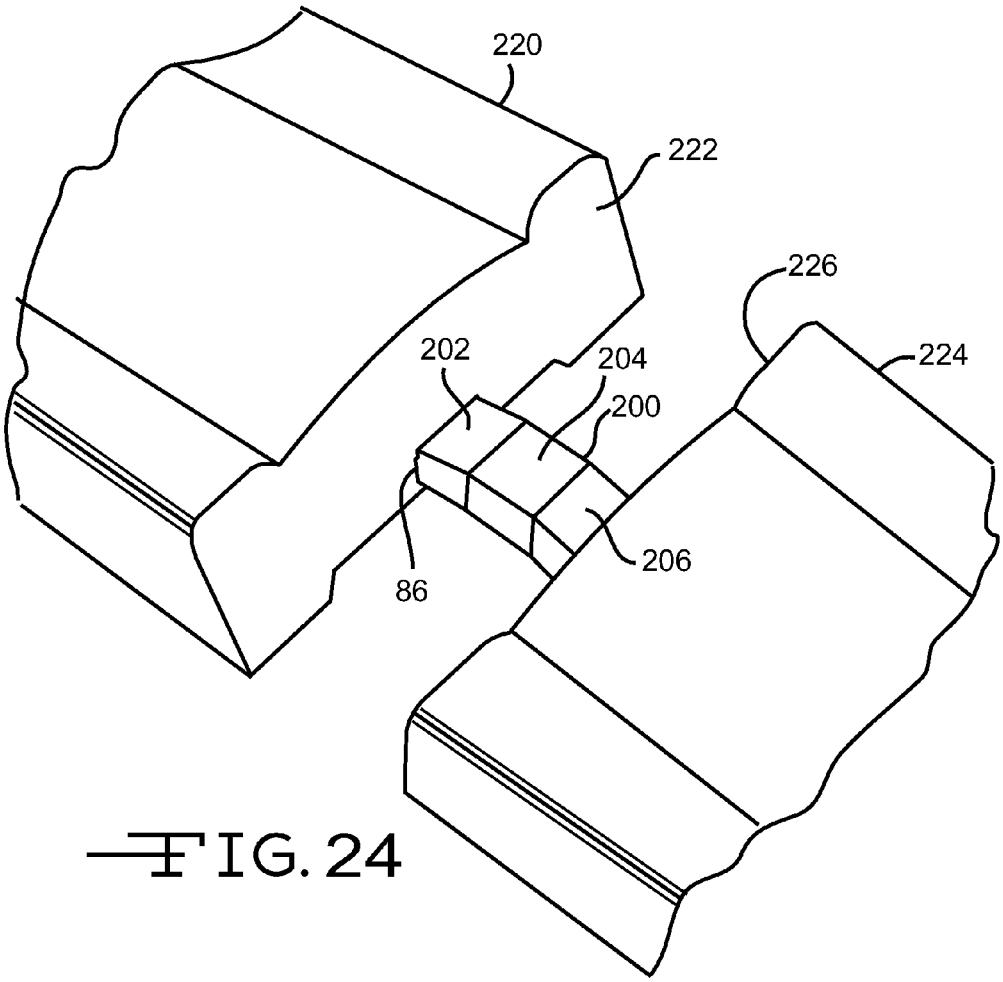
FIG. 24 is a perspective view of an embodiment of the ceiling system according to the invention in which the joining clip shown in FIG. 21 is joining together two molding sections.
Figure 25:
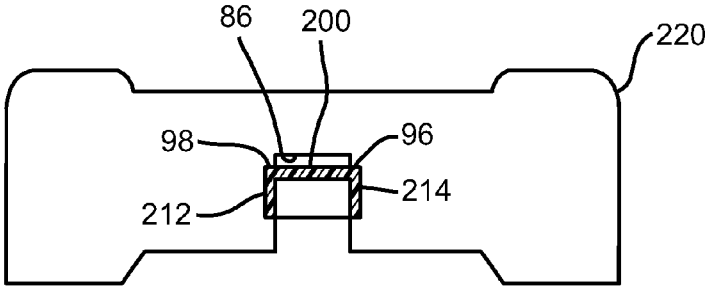
FIG. 25 is a side elevational view showing the joining clip positioned in a section molding slot.

As shown in FIGS. 24 and 25, the joining clip 200 may be used to join together two molding sections of the vertical, horizontal or side moldings 12, 14 and 16, for example, a first molding section 220 having a first molding section end 222 and a second molding section 224 having a second molding section end 226. Each of the first and second molding sections 220 and 224 has a section molding slot 86 as described above. The first end 202 of the joining clip 200 is, for example, inserted in the molding slot 86 of the first molding section 220 and the second end 206 is, for example, inserted in the molding slot 86 of the second molding section 224. The first and second molding sections 220 and 222 are moved together until the joining clip 200 is fully inserted in the respective molding slots 86. This results in the first and second molding section ends 222 and 226 being positioned immediately adjacent to one another to provide a pleasing appearance. As shown in FIG. 25, the joining clip 200 is positioned in the respective molding slots 86 so that the first wall 212 is positioned immediately adjacent to the second enlarged portion wall 98 and the second wall 214 is positioned immediately adjacent to the first enlarged portion wall 96. When so positioned, the first and second members 216 and 218 of the center portion 204 prevent more than half of the joining clip 200 from being inserted in either of the respective molding slots 86. This provides for the proper positioning of the joining clip 200 with respect to the first and second molding sections 220 and 224.

The invention provides an attractive and easy-to-assemble ceiling system for buildings.

While the invention has been described with reference to particular embodiments, it should be understood that various changes may be made and equivalents may be substituted for elements thereof without departing from the essential scope of the invention. In addition, many modifications may be made to adapt a particular situation or material to the teachings of the invention without departing from the essential scope thereof. Therefore, it is intended that the invention not be limited to the particular embodiments, but that the invention shall include all embodiments falling within the scope of the claims.

What is claimed is:

1. A ceiling system comprising:

a first molding having a first molding slot;

a molding clip having a support member portion for positioning on a support member and a first molding slot attachment for positioning in the first molding slot, the support member portion having first and second support member attachment portions that extend continuously along the entire length of the molding clip;

a second molding having a second molding slot;

a molding bracket having a first molding surface for positioning on the first molding and a second molding slot projection for positioning in the second molding slot;

a third molding having a third molding slot;

a rail clip having a rail end for positioning on a side rail and a slot end for positioning in the third molding slot; and a panel for positioning adjacent to at least one of the first, second and third moldings.

2. The ceiling system of claim 1, wherein the first molding slot has a narrow portion including first and second narrow portion walls that are generally parallel to one another and an enlarged portion including first and second enlarged portion walls that are generally parallel to one another and first and second attachment walls that are parallel to one another and on the same plane, the first and second attachment walls are positioned adjacent to and in a generally perpendicular relationship with the first and second narrow portion walls, respectively.

3. The ceiling system of claim 1, wherein the first molding has a clip recess adjacent to the first molding slot.

4. The ceiling system of claim 1, wherein the molding clip has a support member side that includes the support member portion and a molding side that includes the first molding slot attachment, and first and second ends.

5. The ceiling system of claim 4, wherein the first support member attachment portion is positioned at the first end and the second support member attachment portion is positioned at the second end, each of the first and second support member attachment portions includes first and second portions, the first portions being generally perpendicular to the support member side and the second portions being generally parallel to the support member side.

6. The ceiling system of claim 5, wherein each of the first and second ends has a support member projection that projects outwardly from the first portion between the support member side and the second portion.

7. The ceiling system of claim 5, wherein each of the first and second ends has an end projection that projects inwardly from the second portion toward the support member side.

8. The ceiling system of claim 5, wherein the support member side includes a first indentation adjacent to the first end and a second indentation adjacent to the second end.

9. The ceiling system of claim 4, wherein the first molding slot attachment includes first and second molding attachment portions that extend outwardly from the molding side in a generally parallel relationship to one another.

10. The ceiling system of claim 9, wherein each of the first and second molding attachment portions has attachment ends that include a point, a chamfered surface and a support surface.

11. The ceiling system of claim 1, wherein the second molding slot has a narrow portion including first and second narrow portion walls that are generally parallel to one another and an enlarged portion including first and second enlarged portion walls that are generally parallel to one another and first and second attachment walls that are parallel to one another and on the same plane, the first and second attachment walls are positioned adjacent to and in a generally perpendicular relationship with the first and second narrow portion walls, respectively.

12. The ceiling system of claim 1, wherein the second molding has a clip recess adjacent to the second molding slot.

13. The ceiling system of claim 1, wherein the molding bracket has a first surface and a second surface, a slot projection is positioned on the first surface, and a recess projection is positioned on the second surface.

14. The ceiling system of claim 13, wherein the first and second surfaces are generally parallel on different planes.

15. The ceiling system of claim 13, wherein the slot projection has opposed first and second narrow projection sides, opposed first and second enlarged projection sides and a slot surface extending between the first and second enlarged projections sides.

16. The ceiling system of claim 1, wherein the third molding slot has first and second walls that are generally parallel to one another.

17. The ceiling system of claim 1, wherein the slot end has a first portion having a corner and a second portion having an edge, the first and second portions being positioned at a predetermined angle with respect to one another.

18. The ceiling system of claim 17, wherein the edge has first and second points.

19. The ceiling system of claim 1, wherein at least one of the first, second and third moldings includes two molding sections each having a section molding slot.

20. The ceiling system of claim 19, wherein the ceiling system has a joining clip for insertion in each of the section molding slots.

* * * * *